US009521905B1

(12) United States Patent
Suter

(10) Patent No.: US 9,521,905 B1
(45) Date of Patent: Dec. 20, 2016

(54) DRAWER CHEST SYSTEM

(71) Applicant: Craig Suter, Tucson, AZ (US)

(72) Inventor: Craig Suter, Tucson, AZ (US)

( * ) Notice: Subject to any disclaimer, the term of this patent is extended or adjusted under 35 U.S.C. 154(b) by 0 days.

(21) Appl. No.: 15/162,366

(22) Filed: May 23, 2016

(51) Int. Cl.
*A47B 67/04* (2006.01)
*A47B 88/04* (2006.01)
*A47B 88/12* (2006.01)

(52) U.S. Cl.
CPC ..... *A47B 88/0455* (2013.01); *A47B 67/04* (2013.01); *A47B 88/044* (2013.01); *A47B 88/0422* (2013.01); *A47B 88/12* (2013.01); *A47B 2210/0059* (2013.01); *A47B 2210/09* (2013.01)

(58) Field of Classification Search
CPC ..... A47B 67/04; A47B 88/12; A47B 88/044; A47B 88/0422; A47B 88/0455
USPC ..... 312/210, 257.1, 258, 260, 261, 330.1, 312/334.1, 334.7, 350, 351
See application file for complete search history.

(56) References Cited

U.S. PATENT DOCUMENTS

| | | | | | |
|---|---|---|---|---|---|
| 1,398,884 | A | | 11/1921 | Aills | |
| 2,226,670 | A | * | 12/1940 | Pratt | A47B 88/20 206/511 |
| 2,784,027 | A | | 3/1957 | Temp | |
| 2,978,153 | A | | 4/1961 | Brindle | |
| 3,120,076 | A | * | 2/1964 | Zuch | A47B 71/00 312/210 |
| 3,560,022 | A | | 2/1971 | Gold | |
| 4,573,731 | A | | 3/1986 | Knaack et al. | |
| 4,616,890 | A | * | 10/1986 | Romick | E05B 65/462 312/216 |
| 4,705,315 | A | | 11/1987 | Cherry | |
| 4,789,195 | A | | 12/1988 | Fletcher | |
| 4,967,944 | A | | 11/1990 | Waters | |
| 5,088,636 | A | | 2/1992 | Barajas | |
| 5,125,710 | A | | 6/1992 | Gianelo | |
| 5,421,645 | A | | 6/1995 | Young | |
| 5,743,584 | A | | 4/1998 | Lance et al. | |
| 5,845,952 | A | | 12/1998 | Albertini et al. | |
| 5,848,818 | A | | 12/1998 | Flueckinger | |
| 5,857,757 | A | | 1/1999 | Bieker et al. | |
| 5,988,473 | A | | 11/1999 | Hagan et al. | |
| 5,996,868 | A | | 12/1999 | Paradis | |
| 6,003,924 | A | | 12/1999 | Nicol et al. | |
| D426,187 | S | | 6/2000 | Shultz | |
| 6,283,526 | B1 | | 9/2001 | Keough et al. | |
| 6,318,781 | B1 | | 11/2001 | Mc Kee | |
| 6,328,364 | B1 | | 12/2001 | Darbishire | |
| 6,328,365 | B1 | | 12/2001 | Adsit | |
| 6,491,331 | B1 | | 12/2002 | Fox | |
| 6,634,728 | B1 | | 10/2003 | Leguin | |
| 6,641,236 | B2 | | 11/2003 | Grudzien | |
| 6,695,375 | B1 | | 2/2004 | May | |
| 6,923,354 | B2 | | 8/2005 | Axelson | |
| 7,114,754 | B2 | | 10/2006 | Morello | |

(Continued)

OTHER PUBLICATIONS http://www.stackbin.com/products/1-cust-1-custom-container-1/.
http://www.ebay.com/itm/20-PERFORATED-STAINLESS-STEEL-TOOL-BOX-CAN-HOLDER-a-snap-2-use-hang-on-side/371614226711?_trksid=p2047675.c100011.m1850&_trkparms=aid%3D222007%26algo%3DSIC.MBE%26ao%3D1%26asc%3D36540%26meid%3D1e9e5b16455d4dca9498eefcc7a3bebc%26pid%3D100011%26rk%3D2%26rkt%3D10%26sd%3D371538755773.

*Primary Examiner* — James O Hansen

(57) ABSTRACT

A drawer chest system wherein the drawer rails are secure within the system via minimal bolting and merely resting on the drawer chest walls. This allows for higher drawer mobility and reduces the chances of drawers getting stuck within a chest due to clearance issues or inadequate manufacturing tolerances. Furthermore, lower production price accompanies this loosened tolerance.

2 Claims, 9 Drawing Sheets

(56) References Cited

U.S. PATENT DOCUMENTS

| | | | |
|---|---|---|---|
| 7,185,959 | B2 | 3/2007 | Mueller et al. |
| 7,367,571 | B1 | 5/2008 | Nichols et al. |
| 7,494,171 | B2 | 2/2009 | Martin et al. |
| 7,543,873 | B1 | 6/2009 | Thornsberry |
| 7,726,719 | B1 | 6/2010 | Barron |
| 8,668,209 | B1 | 3/2014 | Anzivino et al. |
| 8,708,397 | B2 | 4/2014 | Daylong |
| 8,857,684 | B1 | 10/2014 | Calvert |
| 2003/0011207 | A1 | 1/2003 | Campbell |
| 2003/0107307 | A1 | 6/2003 | Chen |
| 2003/0189074 | A1 | 10/2003 | Dise et al. |
| 2004/0080248 | A1 | 4/2004 | Klusmeier |
| 2005/0103783 | A1 | 5/2005 | Bergum et al. |
| 2005/0146151 | A1 | 7/2005 | Walker |
| 2007/0158968 | A1 | 7/2007 | Chandler et al. |
| 2008/0231066 | A1 | 9/2008 | Harrell |
| 2009/0066207 | A1 | 3/2009 | Laible |
| 2009/0115301 | A1 | 5/2009 | Cunsolo |
| 2010/0171334 | A1 | 7/2010 | Crandall |
| 2014/0231477 | A1 | 8/2014 | Perkins |

* cited by examiner

DRAWER CHEST SYSTEM

BACKGROUND OF THE INVENTION

Many drawer chest systems today are mass produced at low prices. This translates into production methods that are lenient with regards to manufacturing tolerances. Although this allows for drawer chests to be created cheaply, the quality can be subpar. Specifically, drawers within the chests often get stuck or are hard to pull out and push in.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

A drawer chest system wherein the drawer rails are secure within the system via minimal bolting and merely resting on the drawer chest walls. In some embodiments, this allows for higher drawer mobility and reduces the chances of drawers getting stuck within a chest due to clearance issues or inadequate manufacturing tolerances. Furthermore, lower production price accompanies this loosened tolerance.

DESCRIPTION OF PREFERRED EMBODIMENTS

Figure 1:
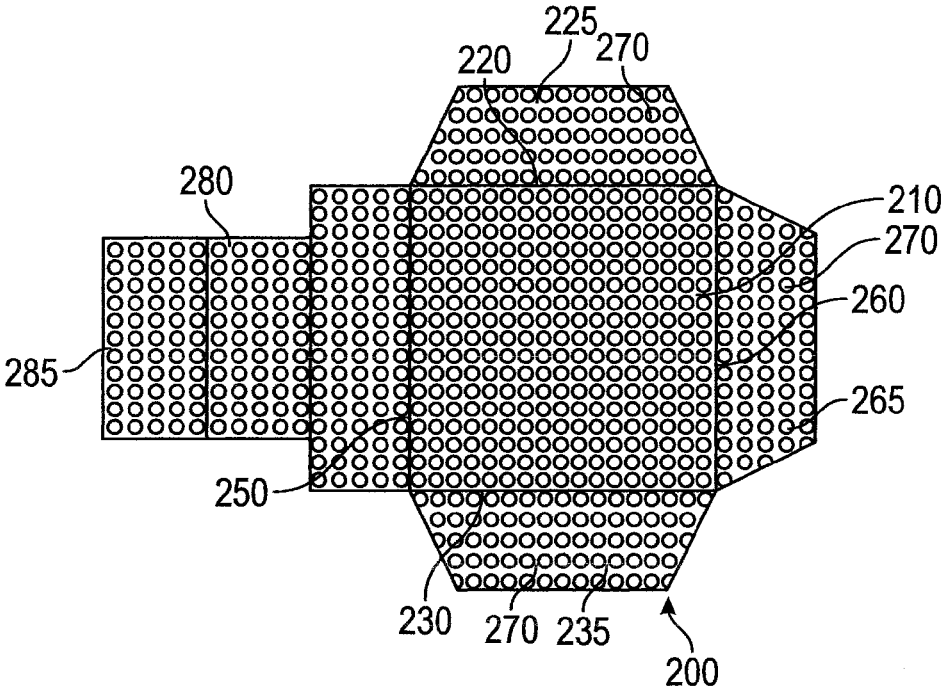
FIG. 1 shows the layout view of the base plate (200).
Figure 2:
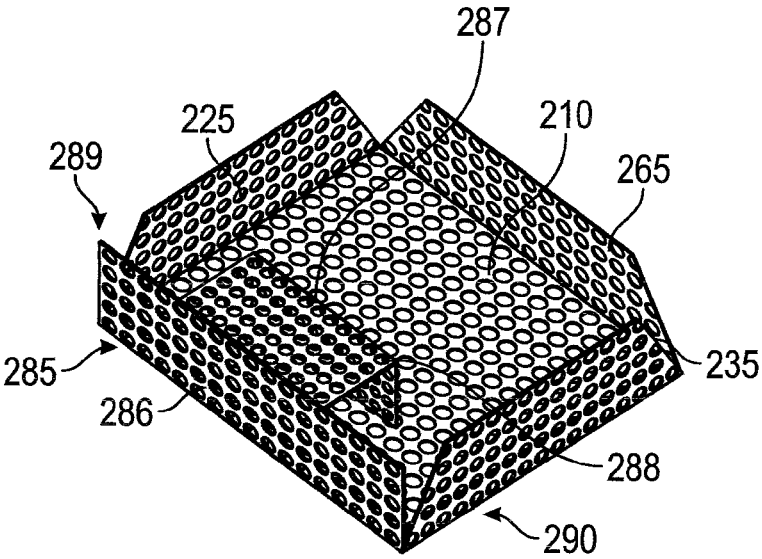
FIG. 2 shows the base plate (200).
Figure 10:
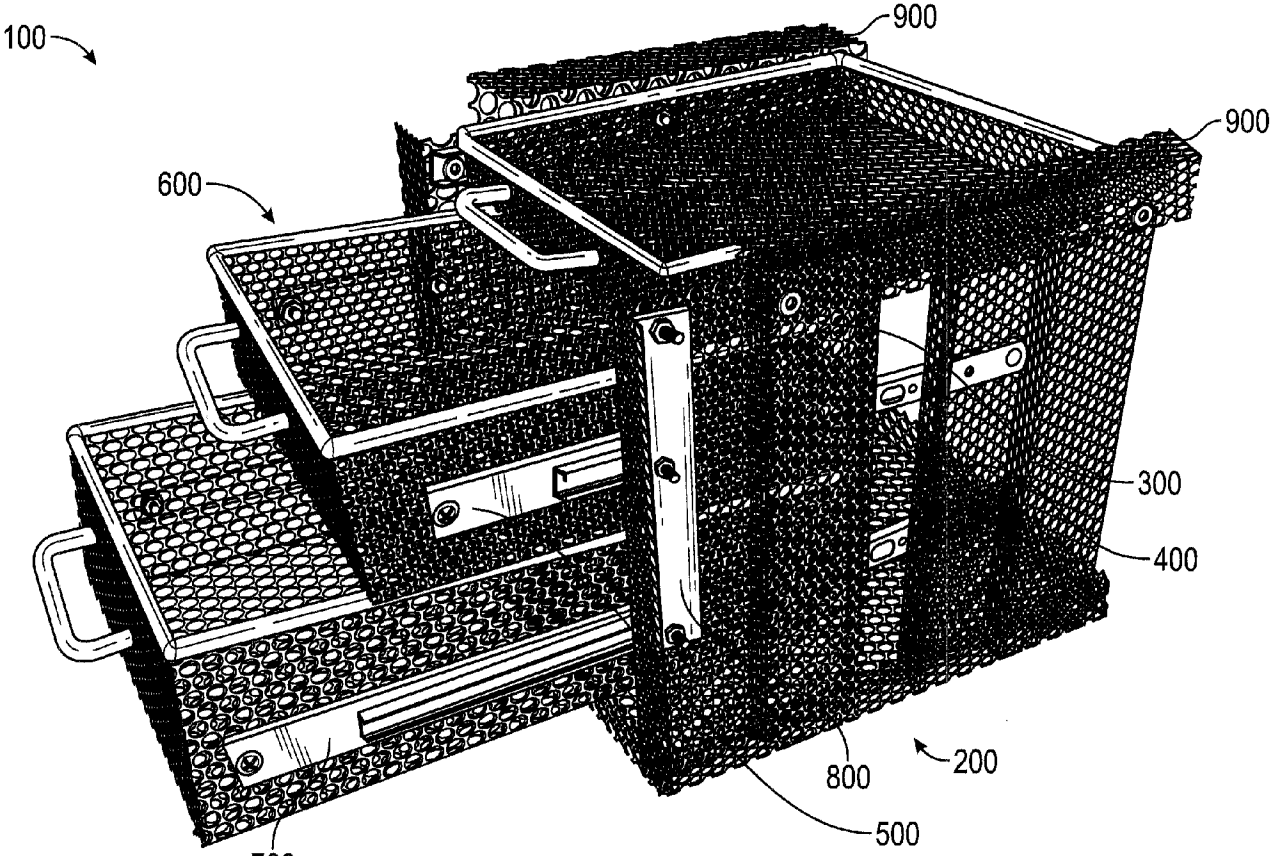
FIG. 10 shows a full assembly of the drawer chest system (100).

Following is a list of elements corresponding to a particular element referred to herein:

100 drawer chest system
200 base plate
210 base plate surface
220 base plate first edge
225 base first wall
230 base plate second edge
235 base second wall
250 base plate front edge
260 base plate back edge
265 base back wall
270 trapezoidal wall plate
280 rectangular wall plate
285 base barrier
286 base barrier front surface
287 base barrier top surface
288 base barrier back surface
289 base barrier first end
290 base barrier second end
300 side plate
310 side plate first end
315 side plate first wall
320 side plate second end
325 side plate second wall
330 side plate channel
331 channel slot
332 slot first edge
333 slot second edge
334 slot bottom edge
335 slot top edge
336 rail rest plate
337 rail anchor plate
340 side plate surface
400 back side plate
430 back side plate channel
440 channel slot
500 drawer rail
510 inside rail
520 outside rail
600 drawer
610 drawer first side
620 drawer second side
700 rail adaptor plate
800 support rail
900 brace plates Referring now to FIG. 10, the present invention is shown. The present invention is a drawer chest system (100) having a base plate (200) comprising a base plate surface (210), a base plate first edge (220), a base plate second edge (230), a base plate front edge (250), and a base plate back edge (260). In some embodiments, a trapezoidal wall plate (270) is disposed adjacent to each of the base plate first edge (220), the base plate second edge (230), and the base plate back edge (260). In some embodiments, a rectangular wall plate (280) is disposed adjacent to the base plate front edge (250). Referring now to FIG. 1 and FIG. 2, the base plate (200) is shown.

Figure 3:
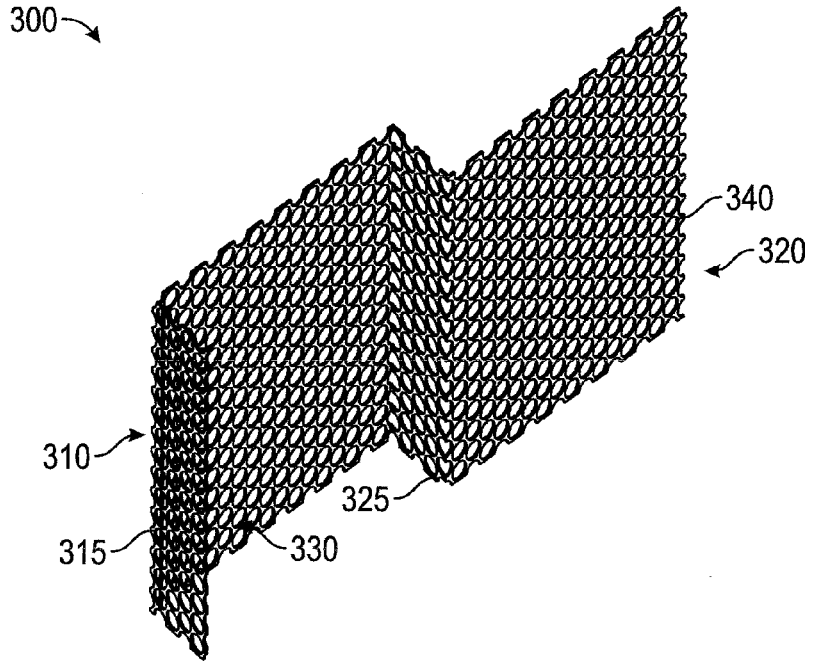
FIG. 3 shows the side plate (300).

In some embodiments, the trapezoidal wall plates (270) are folded perpendicular to the base plate (200) to form a base first wall (225), a base second wall (235), and a base back wall (265). In some embodiments, the rectangular wall plate (280) is folded thrice to form a base barrier (285) comprising a base barrier first end (289), a base barrier second end (290), a base barrier front surface (286), a base barrier top surface (287), and a base barrier back surface (288), In some embodiments, the drawer chest system (100) comprises a pair of side plates (300), wherein each side plate (300) has a side plate first end (310) and a side plate second end (320). In some embodiments, the side plate first end (310) and the side plate second end (320) are bent to form a side plate channel (330) between a side plate first wall (315) and a side plate second wall (325). In some embodiments, the side plate second wall (325) is also bent to form a side plate surface (340). In some embodiments, the side plate surface (340) is parallel to the trough of the side plate channel (330). Referring now to FIG. 3, the side plate (300) is shown.

Figure 5:
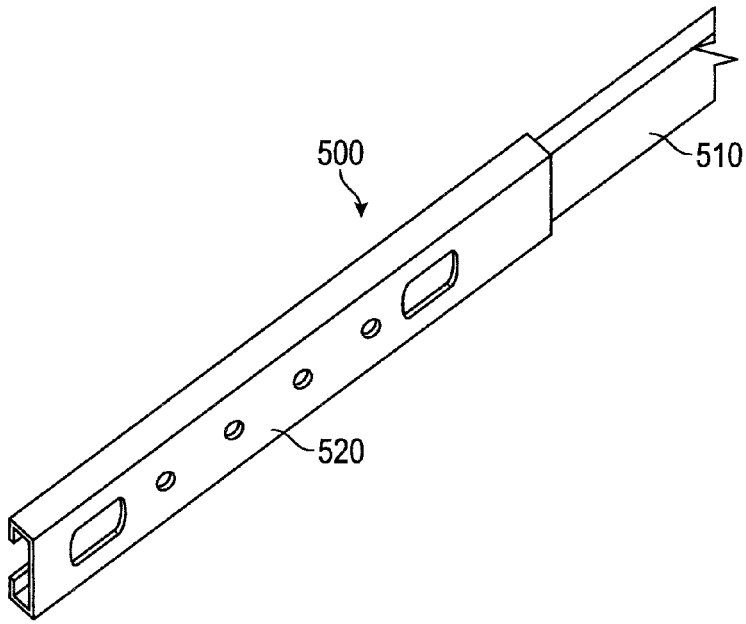
FIG. 5 shows the drawer rail (500).

In some embodiments, the drawer chest system (100) comprises a standard pair of drawer rails (500) each having an inside rail (510) and an outside rail (520). Referring now to FIG. 5, the drawer rail (500) is shown.

Figure 5A:
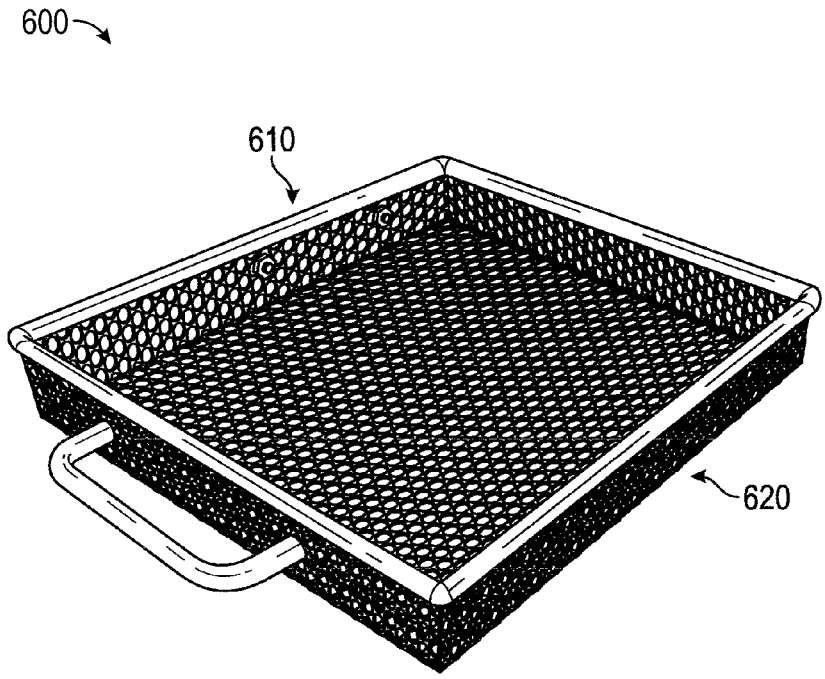
FIG. 5A shows the drawer (600).
Figure 6:
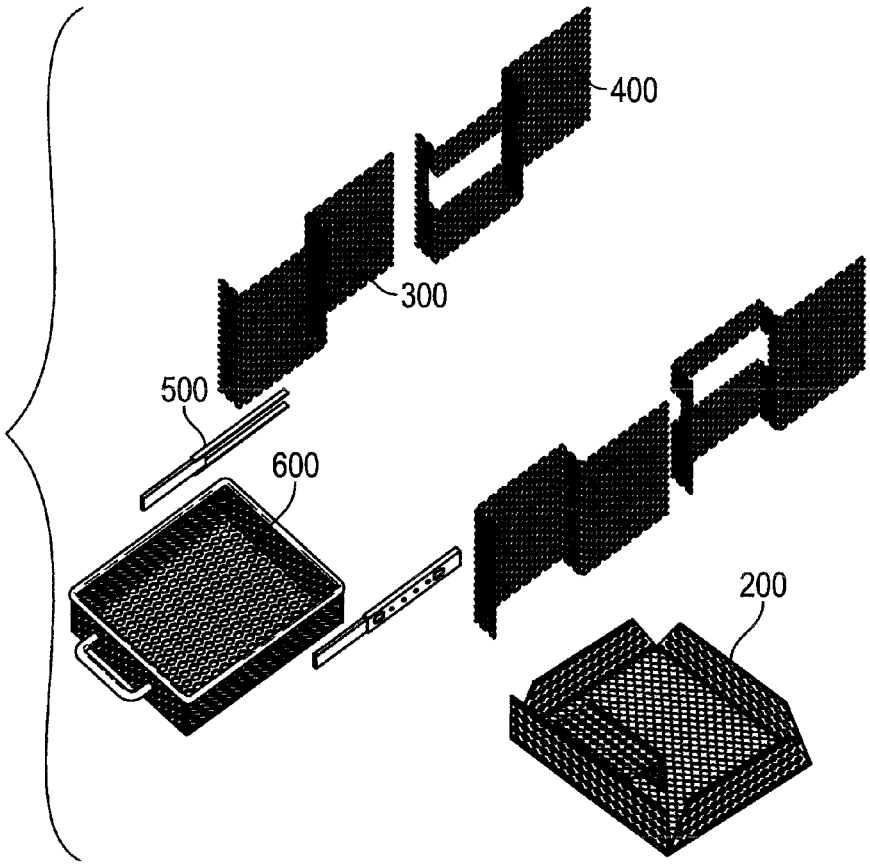
FIG. 6 shows the exploded view of the drawer chest system (100).

In some embodiments, the drawer chest system (100) comprises a drawer (600) having a drawer first side (610) and a drawer second side (620). Referring now to FIG. 5A, the drawer (600) is shown.

Non-Limiting Example 1

Figure 4:
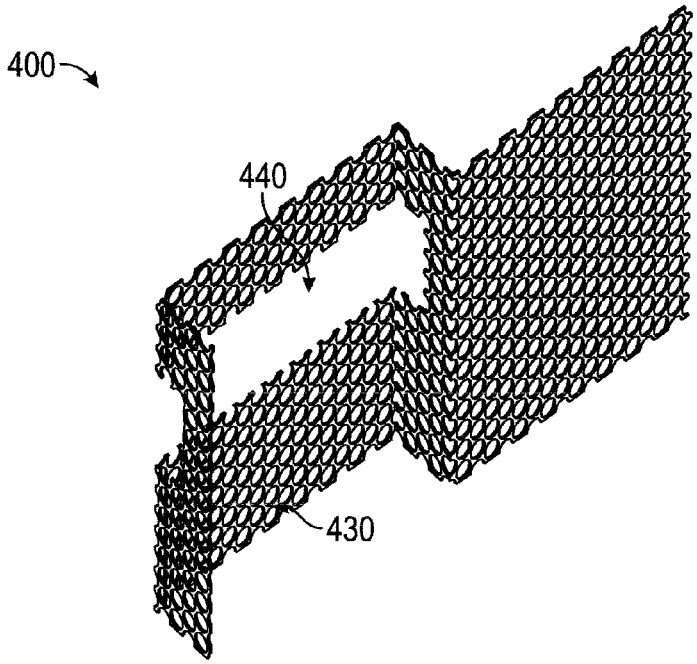
FIG. 4 shows the back side plate (400).

In a non-limiting example, the drawer chest system (100) comprises a pair of back side plates (400) each having the same geometry as the pair of side plates (300), with the exception of the back side plate (400) having a back side plate channel (430) with a deeper trough. Furthermore, a channel slot (440) is disposed on the back side plate channel (430). With material removed from the system (100), the channel slot (440) reduces the overall weight of the drawer chest system (100). Referring now to FIG. 4, the back side plate (400) is shown.

In some embodiments, the assembly of the drawer chest system (100) is as follows: the pair of side plates (300) is attached to the base plate (200) opposing and parallel to each other. One side plate surface (340) attaches to the base plate first wall (225) while the other side plate surface (340) attaches to the base plate second wall (235). In some embodiments, the pair of side plates (300) is attached to the base plate (200) via a plurality of rivets.

The pair of back side plates (400) is attached to the base plate (200) opposing and parallel to each other in the same configuration as the pair of side plates (300).

In some embodiments, the base barrier top surface (287) and the base barrier back surface (288) are partially cut out at the base barrier first end (289) and base barrier second end (290). This is such that the side plate first wall (315) can be disposed on the base barrier front surface (286).

Figure 7:
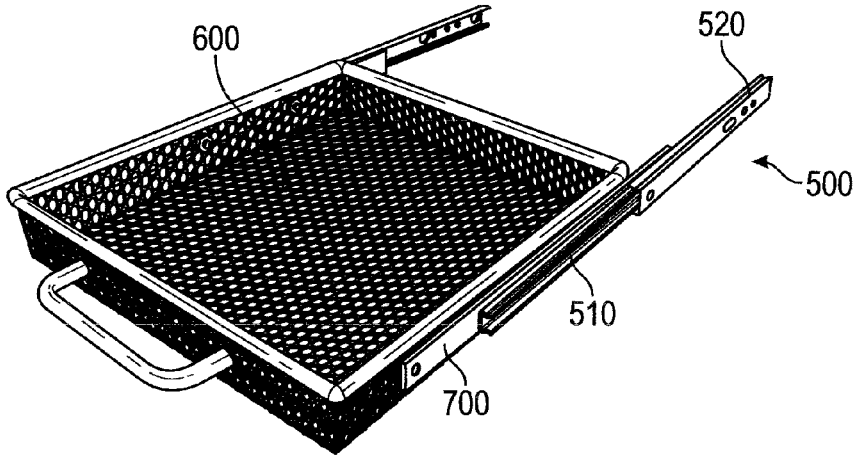
FIG. 7 shows the drawer rail (500) and drawer (600) assembly.

Continuing with the non-limiting example assembly, the pair of drawer rails (500) is each attached to the drawer (600) opposing and parallel to each other, via one inside rail (510) attaching to the drawer first side (610) and the other inside rail (510) attaching to the drawer second side (620). In some embodiments, a rail adaptor plate (700) is sandwiched in between the inside rail (510) and the drawer (600), such that a plurality of 8-32 jam nuts and lock set screws hold the three components together. Referring now to FIG. 7, an assembly of the pair of drawer rails (500) and the drawer (600) is shown.

Figure 9:
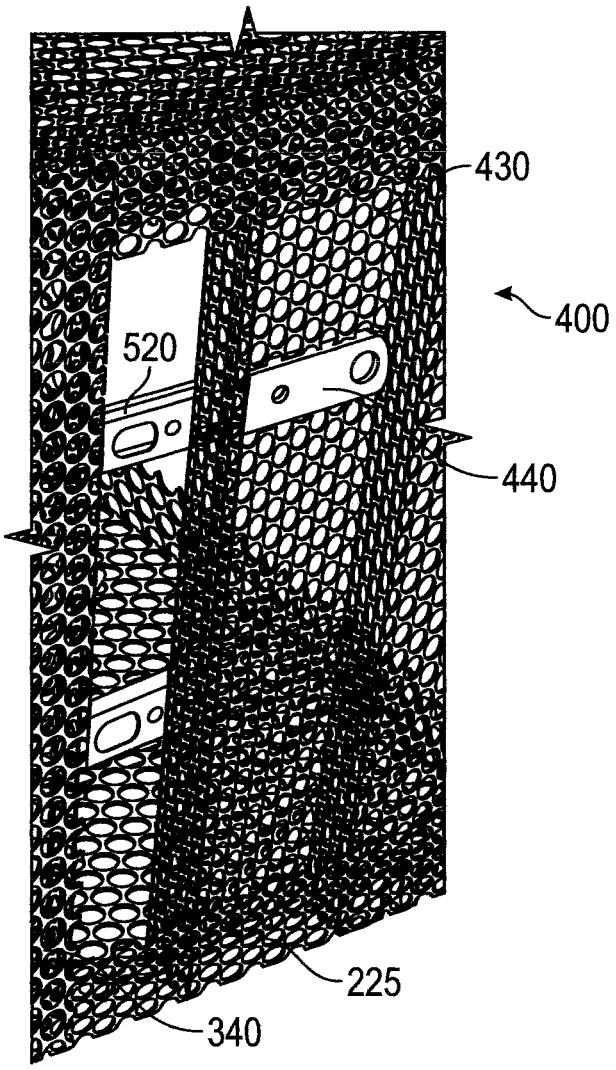
FIG. 9 shows the close-up view of outside rail (520) resting in the channel slot (440).

Each of the pair of outside rails (520) is then attached to the side plate (300) and secured to the back side plate (400) via the outside rail (520) resting stably on the channel slot (440). In some embodiments, a support rail (800) is disposed in and along the side plate channel (330). In some embodiments, the support rail (800) is attached to the side plate channel (330) with a plurality of 4-40 socket head or flat head screws. In some embodiments, the outside rail (520) attaches to the support rail (800) and thus the side plate (300) with 8-32 socket set screws. The pair of drawer rails (500) now allows the drawer (600) to slide fluidly along the side plate (300) and the back side plate (400). Referring now to FIG. 9, the free-to-slide drawer (600) resting on the channel slot (440) is shown.

In some embodiments, the drawer chest system (100) comprises a pair of brace plates (900) each attached to the side plate surface (340) and the corresponding back side plate surface to align the two components.

Figure 8:
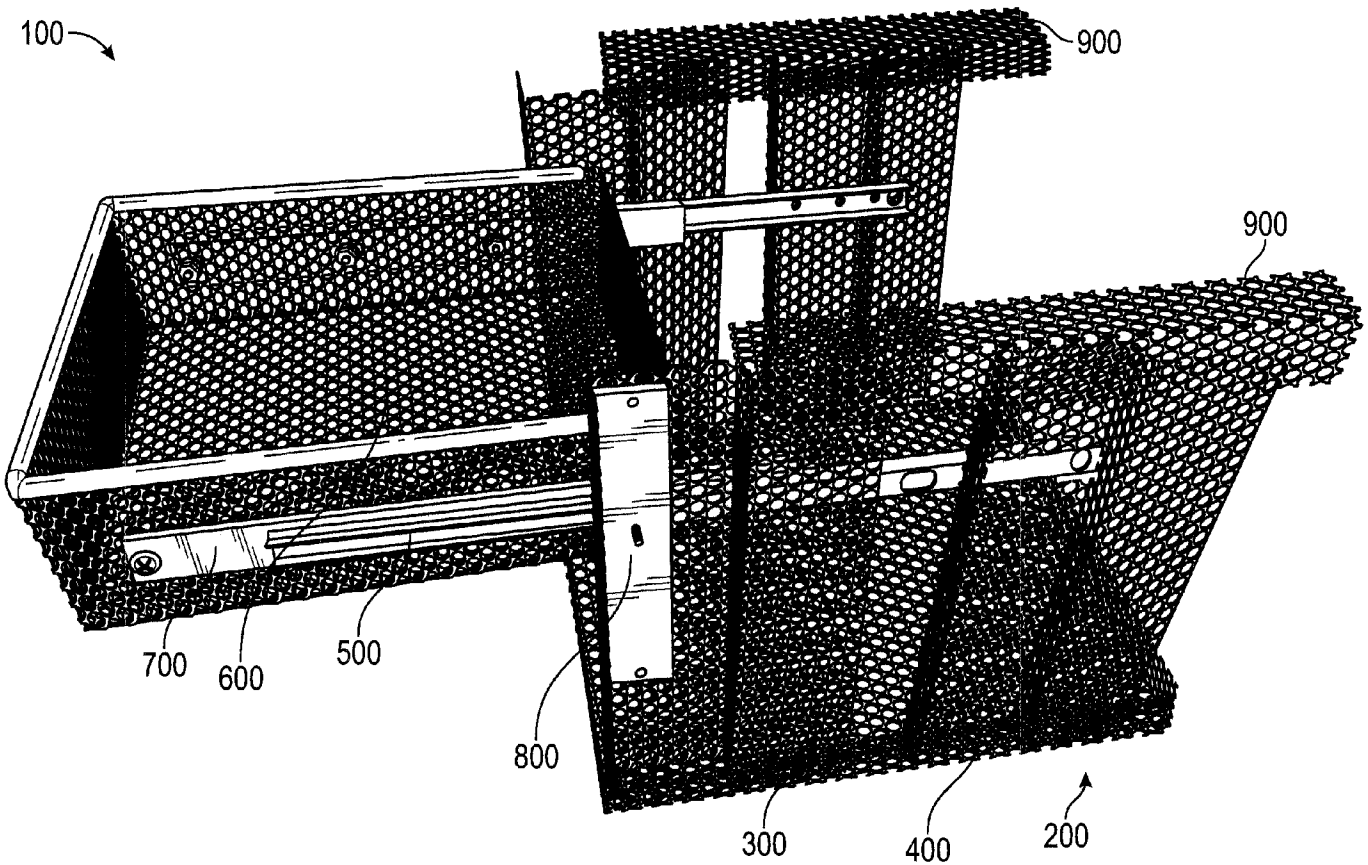
FIG. 8 shows a partial assembly of the drawer chest system (100).

In some embodiments, physical surfaces of the present invention are designed to be perforated. Referring now to FIG. 8, an embodiment of the assembly of the system (100) is shown.

Non-Limiting Example 2

Figure 11A:
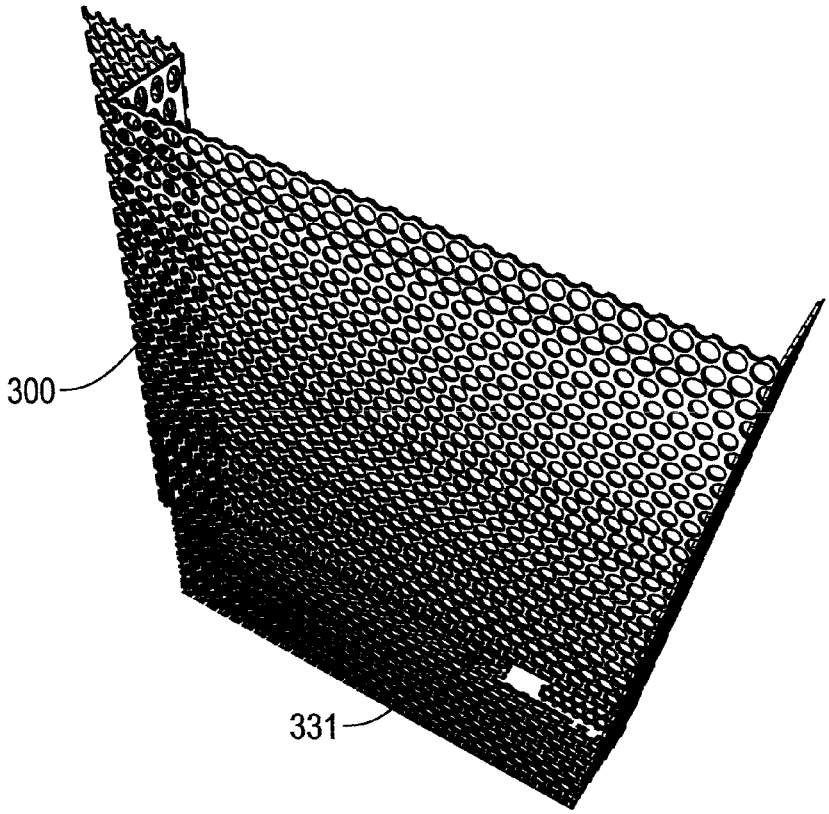
FIG. 11A shows the alternate configuration of the side plate channel (330).
Figure 11B:
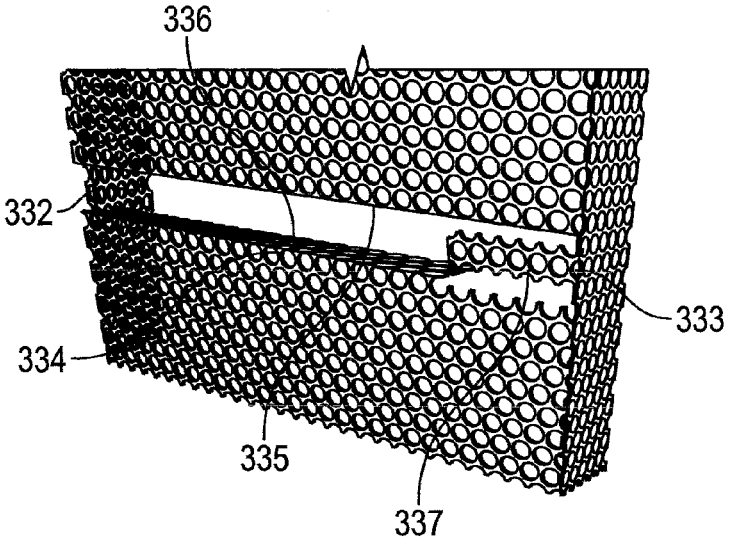
FIG. 11B shows the close-up view of the alternate configuration of the side plate channel (330).

In another non-limiting example, a different configuration of the drawer chest system (100) entails a channel slot (331) being disposed on the side plate channel (330). The channel slot (331) comprises a slot first edge (332), a slot second edge (333), a slot bottom edge (334), and a slot top edge (335). A rail rest plate (336) extends from and perpendicular to the slot bottom edge (334) into the side plate channel (330). A rail anchor plate (337) extends from and perpendicular to the slot first edge (332) into the side plate channel (330). Referring now to FIG. 11A and FIG. 11B, the alternate configuration of the side plate channel (330) is shown.

In some embodiments, the assembly of the drawer chest system (100) is as follows: the pair of side plates (300) is attached to the base plate (200), each opposing and parallel to each other. One side plate surface (340) attaches to the base plate first wall (225) while the other side plate surface (340) attaches to the base plate second wall (235). In some embodiments, the pair of side plates (300) is attached to the base plate (200) via a plurality of rivets.

In some embodiments, the base barrier top surface (287) and the base barrier back surface (288) are partially cut out at the base barrier first end (289) and base barrier second end (290). This is such that the side plate first wall (315) can be disposed on the base barrier front surface (286).

Continuing with the non-limiting example assembly, the pair of drawer rails (500) is each attached to the drawer (600) opposing and parallel to each other, via one inside rail (510) attaching to the drawer first side (610) and the other inside rail (510) attaching to the drawer second side (620). In some embodiments, a rail adaptor plate (700) is sandwiched in between the inside rail (510) and the drawer (600), such that a plurality of 8-32 jam nuts and lock set screws hold the three components together.

Figure 12:
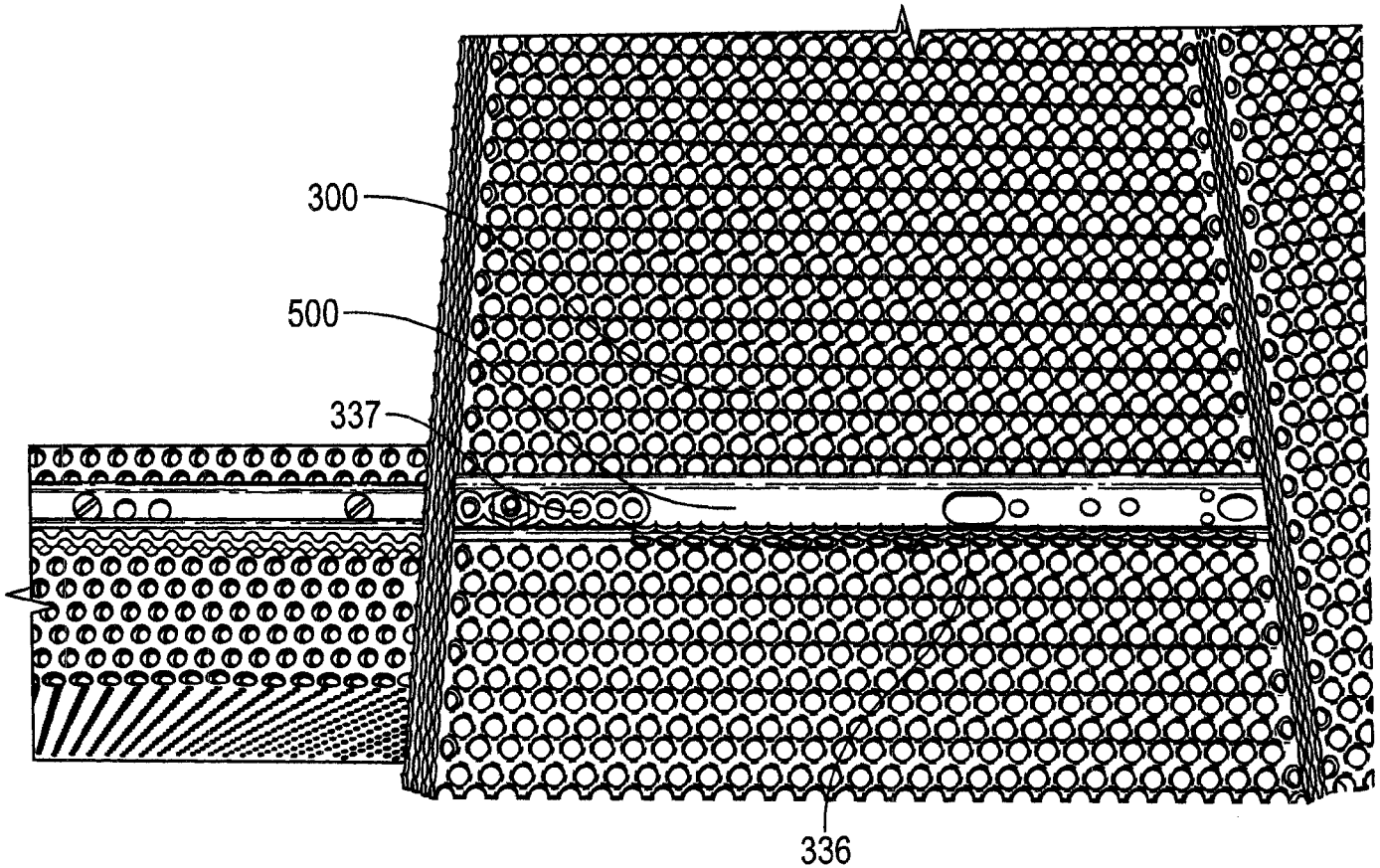
FIG. 12 shows the outside rail (520) attached to the side plate channel (330).

The outside rail (520) is then attached to the rail anchor plate (337) and rests stably on the rail rest plate (336). In some embodiments, the outside rail (520 attaches to the rail anchor plate (337) with 8-32 socket set screws. The pair of drawer rails (500) now allows the drawer (600) to slide fluidly along the side plate (300). Referring now to FIG. 12, how the outside rail (520) attaches to the side plate channel (330) is shown.

In some embodiments, physical surfaces of the present invention are designed to be perforated.

In both non-limiting examples above, the pair of outside rails (520) each either rests on a channel slot (440) or a rail rest plate (336). Without wishing to limit the invention to any theory or mechanism, it is believed that the configurations presented in the examples allow the outside rail (520) to be secured without excessive bolting, thus allowing for higher drawer mobility and reducing the chances of the drawer (600) getting stuck within the system (100) due to clearance issues or inadequate manufacturing tolerances. Furthermore, since drawer mobility is introduced with the present invention, production prices are lowered as manufacturing tolerances are loosened.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A drawer chest system (100), comprising:

a base plate (200) having a base plate surface (210) comprising a base plate first edge (220), a base plate second edge (230), a base plate front edge (250), and a base plate back edge (260), a trapezoidal wall plate (270) disposed adjacent to each of the base plate first edge (220), the base plate second edge (230), and the base plate back edge (260), a rectangular wall plate (280) disposed adjacent to the base plate front edge (250), wherein each of the trapezoidal wall plates (270) are folded perpendicular to the base plate (200) to form a base first wall (225), a base second wall (235), and a base back wall (265), wherein the rectangular wall plate (280) is folded thrice to form a base barrier (285) comprising a base barrier first end (289), a base barrier second end (290), a base barrier front surface (286), a base barrier top surface (287), and a base barrier back surface (288), a pair of side plates (300) each having a side plate first end (310) and a side plate second end (320), wherein the side plate first end (310) and the side plate second end (320) are bent to form a side plate channel (330) between a side plate first wall (315) and a side plate second wall (325), wherein the side plate second wall (325) is bent to form a side plate surface (340), wherein the side plate surface (340) is parallel to a trough of the side plate channel (330), a pair of back side plates (400) each having the same geometry as the pair of side plates (300), with the exception of the back side plate (400) having a back side plate channel (430) with a deeper trough and a channel slot (440) disposed on the back side plate channel (430), wherein the channel slot (440) reduces weight of the drawer chest system (100), a pair of drawer rails (500) each having an inside rail (510) and an outside rail (520), a drawer (600) having a drawer first side (610) and a drawer second side (620), wherein the pair of side plates (300) is attached to the base plate (200) opposing and parallel to each other, via one side plate surface (340) attaching to the base first wall (225) and the other side plate surface (340) attaching to the base second wall (235), wherein the pair of back side plates (400) is attached to the base plate (200) opposing and parallel to each other in the same configuration, wherein the base barrier top surface (287) and the base barrier back surface (288) are partially cut at the base barrier first end (289) and base barrier second end (290), such that the side plate first wall (315) is disposed on the base barrier front surface (286), wherein the pair of drawer rails (500) is attached to the drawer (600) opposing and parallel to each other, via one inside rail (510) attaching to the drawer first side (610) and the other inside rail (510) attaching to the drawer second side (620), wherein the outside rail (520) is attached to the side plate (300) and secured to the back side plate (400) via the outside rail (520) resting stably in the channel slot (440), wherein the drawer rail (500) allows for the drawer (600) to slide fluidly along the side plate (300) and the back side plate (400), wherein the drawer's (600) mobility within the system (100) increases due to minimal bolting.

2. A drawer chest system (100), comprising:

a base plate (200) having a base plate surface (210) comprising a base plate first edge (220), a base plate second edge (230), a base plate front edge (250), and a base plate back edge (260), a trapezoidal wall plate (270) disposed adjacent to each of the base plate first edge (220), the base plate second edge (230), and the base plate back edge (260), a rectangular wall plate (280) disposed adjacent to the base plate front edge (250), wherein each of the trapezoidal wall plates (270) are folded perpendicular to the base plate (200) to form a base first wall (225), a base second wall (235), and a base back wall (265), wherein the rectangular wall plate (280) is folded thrice to form a base barrier (285) comprising a base barrier first end (289), a base barrier second end (290), a base barrier front surface (286), a base barrier top surface (287), and a base barrier back surface (288), a pair of side plates (300) each having a side plate first end (310) and a side plate second end (320), wherein the side plate first end (310) and the side plate second end (320) are bent to form a side plate channel (330) between a side plate first wall (315) and a side plate second wall (325), wherein the side plate second wall (325) is bent to form a side plate surface (340), wherein the side plate surface (340) is parallel to a trough of the side plate channel (330), wherein a channel slot (331) is disposed on the side plate channel (330), wherein the channel slot (331) comprises a slot first edge (332), a slot second edge (333), a slot bottom edge (334), and a slot top edge (335), wherein a rail rest plate (336) extends from and perpendicular to the slot bottom edge (334) into the side plate channel (330), wherein a rail anchor plate (337) extends from and perpendicular to the slot first edge (332) into the side plate channel (330), a pair of drawer rails (500) each having an inside rail (510) and an outside rail (520), a drawer (600) having a drawer first side (610) and a drawer second side (620), wherein the pair of side plates (300) is attached to the base plate (200) opposing and parallel to each other, via one side plate surface (340) attaching to the base first wall (225) and the other side plate surface (340) attaching to the base second wall (235), wherein the base barrier top surface (287) and the base barrier back surface (288) are partially cut at the base barrier first end (289) and base barrier second end (290), such that the side plate first wall (315) is disposed on the base barrier front surface (286), wherein the pair of drawer rails (500) is attached to the drawer (600) opposing and parallel to each other, via one inside rail (510) attaching to the drawer first side (610) and the other inside rail (510) attaching to the drawer second side (620), wherein the outside rail (520) is attached to the rail anchor plate (337) and rests stably on the rail rest plate (336), wherein the drawer rail (500) allows for the drawer (600) to slide fluidly along the front side plate (300), wherein the drawer's (600) mobility within the system (100) increases due to minimal bolting.

* * * * *